US010638588B2

(12) United States Patent
Vinokhodov et al.

(10) Patent No.: US 10,638,588 B2
(45) Date of Patent: Apr. 28, 2020

(54) HIGH-BRIGHTNESS LASER PRODUCED PLASMA SOURCE AND METHODS FOR GENERATING RADIATION AND MITIGATING DEBRIS

(71) Applicants: Isteq B.V., Eindhoven (NL); RnD-ISAN, Ltd, Troitsk, Moscow (RU)

(72) Inventors: Aleksandr Yurievich Vinokhodov, Moscow (RU); Vladimir Vitalievich Ivanov, Moscow (RU); Konstantin Nikolaevich Koshelev, Moscow (RU); Mikhail Sergeyevich Krivokorytov, Moscow (RU); Vladimir Mikhailovich Krivtsun, Moscow (RU); Aleksandr Andreevich Lash, Moscow (RU); Vyacheslav Valerievich Medvedev, Moscow (RU); Yury Viktorovich Sidelnikov, Moscow (RU); Oleg Feliksovich Yakushev, Korolyev (RU)

(73) Assignees: Isteq B.V., Eindhoven (NL); RnD-ISAN, Ltd, Troitsk, Moscow ( * ) Notice: Subject to any disclaimer, the term of this patent is extended or adjusted under 35 U.S.C. 154(b) by 0 days.

(21) Appl. No.: 16/103,243

(22) Filed: Aug. 14, 2018

(65) Prior Publication Data

US 2019/0166679 A1 May 30, 2019

(51) Int. Cl.
*H05G 2/00* (2006.01)

(52) U.S. Cl.
CPC ..... *H05G 2/006* (2013.01); *H05G 2/005* (2013.01); *H05G 2/008* (2013.01)

(58) Field of Classification Search
CPC ..... H05G 2/005; H05G 2/006; H05G 2/008
USPC ..... 250/493.1, 503.1, 504 R
See application file for complete search history.

(56) References Cited

U.S. PATENT DOCUMENTS 7,763,872 B2 * 7/2010 O'Reilly ..... G03F 7/70033 250/492.1

* cited by examiner

*Primary Examiner* — Nicole M Ippolito
*Assistant Examiner* — Hanway Chang
(74) *Attorney, Agent, or Firm* — Nadya Reinhand; Yan Hankin

(57) ABSTRACT

High-brightness LPP source and method for generating short-wavelength radiation which include a vacuum chamber (1) with an input window (6) for a laser beam (7) focused into the interaction zone (5), an output window (8) for the exit of the short-wavelength radiation beam (9); the rotating target assembly (3), having an annular groove (11); the target (4) as a layer of a molten metal formed by centrifugal force on the surface of the distal wall (13) of the annular groove (11) while the proximal wall (14) of the annular groove is designed to provide a line of sight between the interaction zone and both the input and output windows particularly during laser pulses. A method for mitigating debris particles comprises using an target orbital velocity high enough for the droplet fractions of the debris particles exiting the rotating target assembly not to be directed towards the input and output windows.

19 Claims, 8 Drawing Sheets

$$|\vec{V}_R| > |\vec{V}_{d0}|[sin(\gamma/2) + \cos(\gamma/2)\tan(\alpha/2)]/(2\pi R)$$

HIGH-BRIGHTNESS LASER PRODUCED PLASMA SOURCE AND METHODS FOR GENERATING RADIATION AND MITIGATING DEBRIS

CROSS-REFERENCE TO RELATED APPLICATIONS

Current patent application claims priority to the Russian patent application No. 2017141042 filed on Nov. 24, 2017.

FIELD OF INVENTION

The invention relates to a high-brightness radiation source for generating short-wavelength radiation including x-ray, extreme ultraviolet or vacuum ultraviolet, but mainly in the field of extreme ultraviolet EUV at a wavelength of 13.5 nm and to methods for both generating radiation from high-temperature laser produced plasma (LPP) and mitigating debris. The scope of applications includes various types of inspection such as actinic EUV mask inspection at the working wavelength of the lithographic process.

BACKGROUND OF INVENTION

The new generation projection lithography for large-scale production of integrated circuits IC with structure sizes of 10 nm or less is based on the use of EUV radiation in the range of 13.5+/−0.135 nm corresponding to effective reflection of multilayer Mo/Si mirrors. The control of the IC to be defect-free is one of the most important metrological processes of modern nanolithography. The general trend in lithographic production is a shift from IC inspection, which is extremely time-consuming and costly in large-scale production, to the analysis of lithographic masks. In the case of mask defects they are projected onto a silicon substrate with a photoresist, resulting in the appearance of defects on the printed chips. The mask in EUV lithography is a Mo/Si mirror, on top of which a topological pattern is applied from a material that absorbs radiation at a wavelength of 13.5 nm. The most efficient method for the process of mask inspection is carried out at the same wavelength for actinic radiation, that is, radiation, whose wavelength coincides with the working wavelength of the lithography the so-called Actinis Inspection. Such scanning by radiation with a wavelength of 13.5 nm allows the detection of defects with a resolution better than 10 nm.

Thus, the control of defect-free lithographic masks in the process of their production and during the entire period of operation is one of the key challenges for EUV lithography while the creation of a device for the diagnosis of lithographic masks and its key element—a high-brightness actinic source—is a priority for the development of EUV lithography. For these purposes, it is required to develop a relatively compact and economical device on the basis of an EUV source with high brightness radiation $B_{13.5} \geq 100$ $W/mm^2 \cdot sr$ in the spectral band of 13.5+/−0.135 nm and with a small value of etendue $G = S \cdot \Omega \leq 10^{-3}$ $mm^2 sr$, where S is the source area in $mm^2$, Ω the solid angle of the output EUV radiation in steradian.

The radiation sources for EUV lithography are using Sn—plasma generated by a powerful laser system including $CO_2$ lasers. Such sources have the power of EUV radiation exceeding by several orders of magnitude the level of power required for the inspection of EUV masks. Therefore, their usage for mask inspection is inadequate due to the excessive complexity and cost. In this regard, there is a need for other approaches to the creation of high-brightness EUV sources for actinic inspection of EUV masks.

In accordance with one of the approaches, known from U.S. Pat. No. 7,307,375, issued on 12 Nov. 2007, in a high-brightness source of EUV radiation, a pulsed inductive discharge is used to create an electrodeless Z-pinch in gas, in particular, Xe. The device includes a pulsed power system connected to the primary winding coil of the magnetic core that surrounds part of the discharge zone. In this case, the Z-pinch is formed inside an insulating ceramic SiC sleeve with an opening diameter of about 3 mm. This results in sufficiently strong erosion and means the sleeve requires frequent periodic replacement. The source is characterized by simplicity, compactness and relatively low cost. However, the size of the radiating plasma is relatively large, and the maximum reported brightness of the source ~10 $W/mm^2$ sr is lower than that required for a number of applications, including lithographic mask inspection.

This drawback is largely avoided in the device according to the patent application US20150076359, issued on 19 Mar. 2015 which also includes a new method for generating EUV radiation from laser produced plasma. In the embodiment of this invention, the target material is xenon, which is frozen onto the surface of a rotating cylinder cooled by liquid nitrogen. The laser plasma radiation collected by the collector mirror is directed to an intermediate focus. The device and the method allow the achievement of a small size of plasma emitting in the EUV range, a greater brightness of the radiation source up to 80 $W/mm^2 \cdot sr$ in the absence of any contamination of the optics. The disadvantages of this method include insufficiently high efficiency of the plasma-forming target material and the high cost of xenon which requires a complex system for its recirculation.

From the U.S. Pat. No. 8,344,339, issued on 1 Mar. 2012, a known device for the generation of EUV radiation from laser produced plasma including: a vacuum chamber, which houses a rotating rod made of plasma-forming target material, an input window for the laser beam focused in the interaction zone of the laser beam and target, and an EUV beam generated from the laser-produced plasma exiting an output window towards the optical collector. The device and the method of generation of EUV radiation are characterized by the fact that tin Sn is used as the most effective plasma-forming target material and the rod, in addition to rotation, also performs reciprocating axial movements. However, these devices and the method have a number of disadvantages, which include the non-reproducibility of the profile of the solid surface of the target from pulse to pulse during long-term continuous operation of the device, which affects the stability of the output characteristics of the short-wavelength radiation source. The complexity of the design is another disadvantage, since complex movements of the target assembly and its periodic replacement are required. During production of EUV radiation, debris particles are produced as a by-product, which can degrade the optics surface. The level of debris produced in this source is too high and that severely limits the possibilities of its application.

The debris, generated as a by-product of the plasma during the radiation source operation, can be in the form of high-energy ions, neutral atoms and clusters of target material.

The magnetic mitigation technique, disclosed for example in U.S. Pat. No. 8,519,366, issued on 27 Aug. 2013, is arranged to apply a magnetic field so that at least charged debris particles are mitigated. In this patent the debris mitigation system for use in a source for EUV radiation and/or X-rays, includes a rotatable foil trap and gas inlets for the supply of buffer gas to the foil trap so that neutral atoms and clusters of target material are effectively mitigated.

Another debris mitigating technique, known from U.S. Pat. No. 7,302,043, issued on 27 Nov. 2007, is arranged to apply a rotating shutter assembly configured to permit the passage of short-wavelength radiation through at least one aperture during the first period of rotation, and to thereafter rotate the shutter to obstruct passage of the debris through at least one aperture during the second period of rotation.

However, the complexity of using these debris-mitigating techniques in a compact radiation source means that technically they are too difficult to implement.

SUMMARY

The technical problem to be solved by the invention refers to the creation of high-brightness, low-debris radiation sources based on laser-produced plasma mainly for EUV metrology, inspection of nano- and microstructures, including an actinic inspection of masks in EUV lithography.

Achievement of the purpose is possible by means of an apparatus for generating short-wavelength radiation from a laser-produced plasma LPP, which includes a vacuum chamber containing a rotational drive unit coupled to a rotating target assembly which supplies a target to an interaction zone, an input window for a pulsed laser beam focused into the interaction zone, an output window for the exit of the short-wavelength radiation beam and gas inlets.

The apparatus is characterized in that the rotating target assembly has an annular groove with a distal wall and a proximal wall relative to the axis of rotation; the plasma-forming target material is a molten metal located inside the annular groove, and the target is a layer of said molten metal formed by centrifugal force on the surface of the distal wall of the annular groove, and the proximal wall of the annular groove is designed to provide a line of sight between the interaction zone and both the input and output windows particularly during laser pulses.

In the embodiment of the invention the proximal wall of the annular groove has n pairs of openings arranged on a groove circumference, in each of the pairs, a first opening is provided for the focused laser beam input into the interaction zone, and a second opening is provided for the short-wavelength radiation beam output from the interaction zone during the laser pulses that follow at a frequency f equal to a target assembly rotational speed ν multiplied by the number of the opening pairs n: $f=\nu \cdot n$, further comprising a synchronization system which adjusts the annular groove rotation angle with the laser pulses timed to provide a line of sight between the interaction zone and both the input and output windows. In other variants of the invention, the proximal wall of the annular groove has a slit along the entire perimeter of the groove, providing direct visibility between the interaction zone on the one hand and the input and output windows on the other.

In the embodiment of the invention, each twin openings may be joined.

In another embodiment, the proximal wall of the annular groove has a slit along its entire perimeter providing a line of sight between the interaction zone and both the input and output windows.

In an embodiment of the invention, the rotating target assembly is provided with a fixed heating system for the target material.

In a preferred embodiment of the invention, the laser beam and the short-wavelength radiation beam are located on one side of a rotation plane passing through the interaction zone, and a normal vector to the annular groove surface in the interaction zone is located on the opposite side of the rotation plane.

In a preferred embodiment of the invention, the laser beam and the short-wavelength radiation beam are located on one side of a rotation plane passing through the interaction zone, and the rotational drive unit is located on the opposite side of the rotation plane.

In a preferred embodiment of the invention, the annular groove is provided with a cover.

In a preferred embodiment of the invention, a part of the focused laser beam between the input window and the proximal wall of the annular groove is surrounded by a first casing in which a gas flow from the input window to the proximal wall of the annular groove is supplied, and a part of the short-wavelength radiation beam between the proximal wall of the annular groove and the output window is surrounded by a second casing in which a gas flow from the output window to the proximal wall of the annular groove is supplied.

In a preferred embodiment of the invention, devices for magnetic field generation are arranged on the outer surfaces of the said first and second casings.

In an embodiment of the invention, the first and second casings may be integrated together.

In an embodiment of the invention, the input and output windows may be provided with heaters performing highly efficient cleaning by evaporation of debris from the windows.

In an embodiment of the invention, the input and output windows are provided with a system of gas chemical cleaning.

In a preferred embodiment of the invention, the plasma-forming target material is selected from metals providing highly efficient extreme ultraviolet EUV light generation, particularly including Sn, Li, In, Ga, Pb, Bi or their alloys.

In another aspect, the invention relates to a method for generating radiation from a laser-produced plasma, comprising: forming a target by centrifugal force as a layer of molten metal on a surface of an annular groove, implemented inside a rotating target assembly; sending a pulsed laser beam through an input window of a vacuum chamber into an interaction zone while providing a line of sight between the interaction zone and both the input and output windows particularly during laser pulses, irradiating a target on a surface of a rotating target assembly by a laser beam, and passing a generated short-wavelength radiation beam through an output window of a vacuum chamber.

In yet another aspect, the invention relates to a method for mitigating debris in a laser-produced plasma LPP source, characterized by irradiating a target on a surface of a rotating target assembly with a pulsed laser beam, while the laser beam enters through the input window and a generated short-wavelength radiation beam exits through the output window of a vacuum chamber, said method comprising: the target formation by centrifugal force as a layer of molten metal on a surface of an annular groove, implemented inside the rotating target assembly, and using an orbital velocity $V_R$ of the rotating target assembly high enough for the droplet fractions of the debris particles exiting the rotating target assembly not to be directed towards the input and output windows In the embodiment of the invention, the groove has a distal wall and a proximal wall relative to an axis of rotation; the proximal wall has n pairs of openings arranged for the focused laser beam input into an interaction zone and for a short-wavelength radiation beam output from the interaction zone during the laser pulses that follow at a frequency f equal to an orbital velocity $V_R$ of rotating target assembly multiplied by the number n of the opening pairs and divided by the length of the orbital circle 2πR: $f=V_R \cdot n/(2\pi R)$, said method comprising: forming the target on a surface of the distal wall of the annular groove, providing a line of sight between the interaction zone and both the input and output windows by means of two openings, irradiating a target on the surface of a rotating target assembly by a laser beam and passing a generated short-wavelength radiation beam through the output window of a vacuum chamber, restricting a debris flow generated from the interaction zone by apertures of two openings, obstructing the passage of the debris through the proximal wall by closing the line of sight between the interaction zone and both the input and output windows due to rotation of the proximal wall until the next cycle of operation.

In a preferred embodiment of the invention, said openings are elongated channels, which act as rotating debris-trapping surfaces, and said method comprising: trapping the debris particles on the surfaces of the two extended channels and ejecting the trapped debris particles by centrifugal force back into the groove.

In a preferred embodiment of the invention, debris mitigation techniques such as magnetic mitigation, gas curtain and foil traps are additionally used.

The technical result of the invention is the creation of a high-brightness source of the short-wavelength radiation with an extremely low debris level, which ensures an increase in lifetime and a reduction in operating costs.

The foregoing and other objects, advantages and features of the present invention will become more apparent from the following non-limiting description of exemplary embodiments thereof, given by way of example with reference to the accompanying drawings.

BRIEF DESCRIPTION OF THE DRAWINGS

The essence of the invention is explained by the drawings, in which.

These drawings do not cover and, moreover, do not limit the entire scope of options for implementing this technical solution, but are only illustrative materials of particular cases of its implementation.

DETAILED DESCRIPTION OF THE PREFERRED EMBODIMENT

Figure 1:
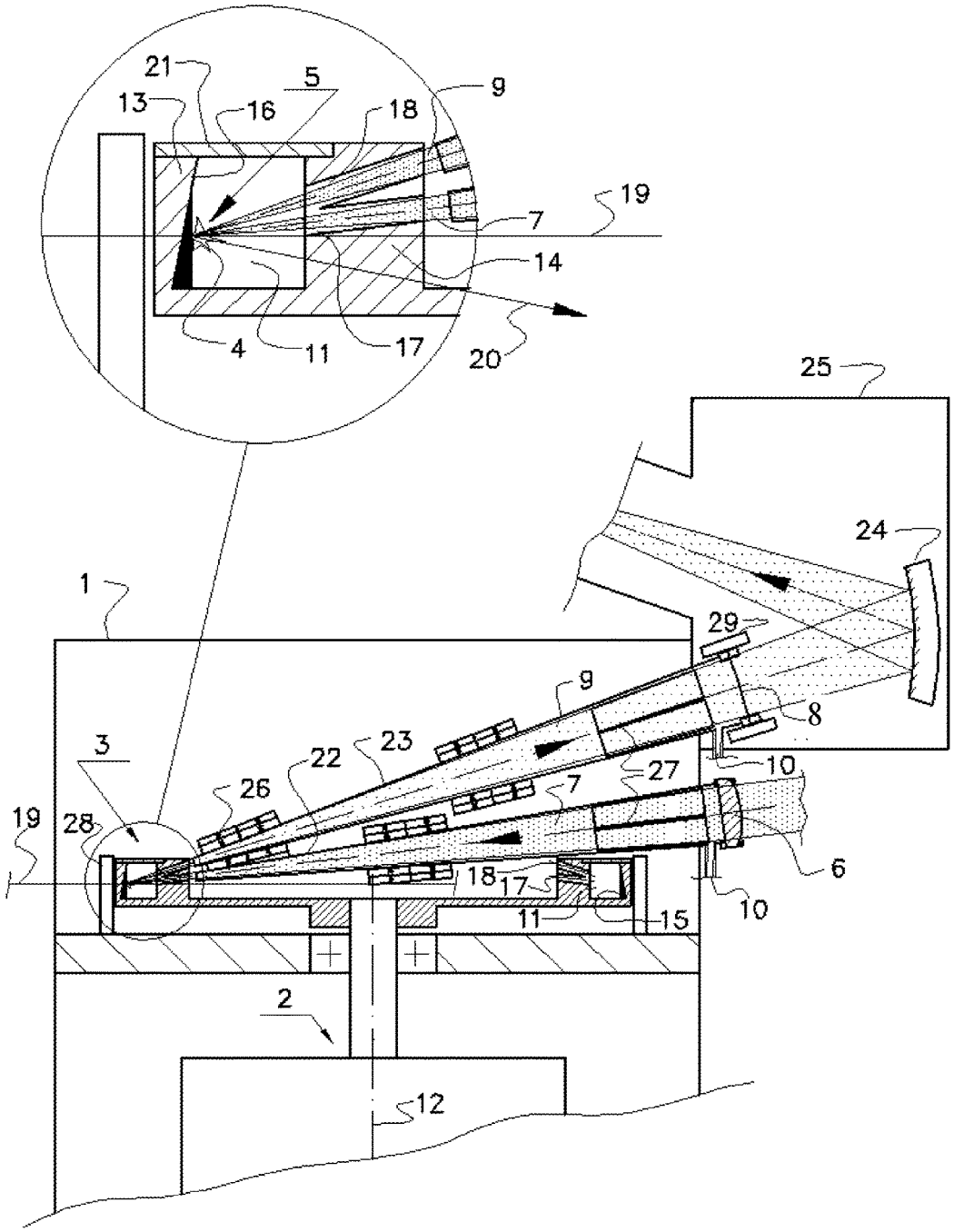
FIG. 1 schematically illustrates a device and method for generating radiation from laser-produced plasma in accordance with embodiments of the present invention.

According to the embodiment of the invention schematically shown in FIG. 1, an apparatus for generating short-wavelength radiation from laser-produced plasma LPP comprises: vacuum chamber 1 containing a rotating target assembly 3 which supplies a target 4 to an interaction zone 5, an input window 6 for a pulsed laser beam 7 focused into the interaction zone, an output window 8 for an exit of the short-wavelength radiation beam 9, and gas inlets 10.

The rotating target assembly 3 has an annular groove 11 with a distal wall 13 and a proximal wall 14 relative to the axis of rotation 12.

The plasma-forming target material 15 is a molten metal located inside the annular groove 11, and the target 4 is a layer of said molten metal formed by a centrifugal force on a surface 16 of the distal wall 13 of the annular groove 11.

The proximal wall 14 of the annular groove 11 is designed to provide a line of sight between the interaction zone 5 and both the input and output windows 6, 8 particularly during laser pulses. For this purpose the proximal wall 14 can have for example either the first and second openings 17, 18, shown in FIG. 1, or a slit along its entire perimeter.

The rotating target assembly 3 is preferably disc-shaped. However, it can have the shape of a wheel, a low polyhedral prism, or another shape.

The apparatus for generating radiation from laser-produced plasma implemented in accordance with the present invention has the following advantages:

- the use of a liquid-phase target, in contrast to solid, ensures the reproducibility of the target surface, which increases the pulse to pulse stability of the output characteristics of the short-wavelength radiation source,
- long-term stability of the short-wavelength radiation source is achieved due to continuous circulation, renewal and replenishment of the target material in the interaction zone,
- the use of laser-produced plasma of metals, in particular tin Sn, ensures both high brightness and high efficiency of the short-wavelength radiation source, in particular, at the working wavelength, 13.5 nm, of the EUV lithography,
- unlike analogues, the proposed design of the rotating target assembly sharply limits the outflow of debris particles beyond it, ensuring the cleanliness of the short-wavelength radiation source and minimum consumption of the target material,
- simplifies the design of the apparatus, reduces the cost of its operation.

In the embodiment of the present invention, schematically shown in FIG. 1, to provide a line of visibility between the interaction zone 5 and both the input and output windows 6, 8, the proximal wall 14 of the annular groove 11 has n pairs of openings 17 and 18 arranged on a groove circumference. In each of the pairs, a first opening 17 is provided for a focused laser beam 7 input into the interaction zone 5, and a second opening 18 is provided for a short-wavelength radiation beam 9 output from the interaction zone during the laser pulses that follow at a frequency f equal to a target assembly rotational speed ν multiplied by the number of the opening pairs n: $f=\nu \cdot n$. The number of pairs of openings n can be in the range of several tens to hundreds.

In this embodiment of the invention, the apparatus can operate using a synchronization system for simplicity (not shown) which adjusts an annular groove 11 rotation angle with laser pulses timed to provide a line of sight between the interaction zone 5 and both the input and output windows 6 and 8.

Synchronization system can include an auxiliary continuous wave laser irradiating the surface of the rotating target assembly with n radial markers located along its circumference, each of which is at the same angle to the axis of one of the n first openings 17. In this case, the photodetector detects a reflected continuous signal of the auxiliary laser radiation, modulated by the markers and starts the main pulsed laser at the rotation angles of the annular groove 11, which provide a line of visibility between the interaction zone 5 and the input and output windows 6, 8 through the first and second openings 17, 18 in the proximal wall 14.

In this embodiment, the strongest restriction of the debris flux is achieved, since there is only one pair of small openings 17, 18 through which the exit of debris from the rotating target assembly 3 is possible. Along with this, obstruction of the passage of the debris through the proximal wall 14 is provided by closing the line of sight between the interaction zone 5 and both the input and output windows 6, 8 due to rotation of the proximal wall 14 until the next cycle of short-wavelength radiation generation.

The micro droplets of the target material, passing into the openings 17, 18, for the most part move at an angle to the axis of these openings. Therefore, with a high probability, the micro droplets fall onto the rotating wall of the openings, are absorbed by surfaces and then are ejected back into the annular groove 11 under the action of a centrifugal force. Thus the plasma-forming material of the target does not leave the annular groove 11, increasing the source lifetime without the need for refueling.

Preferably, openings 17, 18 are elongated channels, which efficiently absorb the debris particles on their surfaces and then eject the trapped debris particles by centrifugal force back into the annular groove 11.

The axis of the openings 17 and 18 may be located on one surface of rotation, or on different surfaces of rotation, as shown in FIG. 1. The shape of the first and second openings 17, 18 in the proximal wall 14 of the annular groove 11 may be cylindrical, conical, rectangular or slotted but not limited thereto. Each twin openings 17 and 18 may be joined or combined together.

In another embodiment of the invention the proximal wall 14 of the annular groove 11 has a slit along its entire perimeter providing a line of sight between the interaction zone 5 and both the input and output windows 6 and 8. In this arrangement synchronization between laser pulses and the rotation angle of the annular groove 11 is not required. This simplifies the operation of the apparatus at high pulse repetition frequency f, even up to 10 MHz.

The orbital velocity $V_R$ of the target 4 on the distal wall 13 of the rotating target assembly 3 is mainly perpendicular to both the direction of the laser beam 7 and the short-wavelength radiation beam 9, which prevents debris particles from getting into windows 6 and 8. So, to prevent the droplet fractions of the debris particles exiting the rotating target assembly 3 from being directed towards the input and output windows 6 and 8, the orbital velocity $V_R$ of the rotating target assembly 3 should be high enough.

In the coordinate system of the rotating target assembly 3 the movement of plasma, vapor, clusters and droplets of the target material from the interaction zone 5 occurs substantially in the direction close to that of the normal vector 20 to the surface of the target 4 in the interaction zone 5. When the rotational speed is high enough, the surface of the target 4 is parallel to the axis of rotation 12 and the normal to its surface lies in the plane of rotation 19, which crosses interaction zone 5. Because of this, in preferable embodiments of the invention the laser beam 7, except for its apex, and the short-wavelength radiation beam 9, except for its apex, are situated outside the rotation plane 19 which crosses interaction zone 5. This additionally prevents debris particles from getting into the windows 6 and 8.

When the centrifugal force is high enough, the surface of the target 4 is parallel to the axis of rotation 12 and the normal to its surface lies in the plane of rotation 19, which crosses interaction zone 5. Because of this, in preferable embodiments the laser beam 7, except for its apex, and the short-wavelength radiation beam 9, except for its apex, are situated outside the rotation plane 19. This also prevents debris particles from getting into the windows 6 and 8.

Another substantial direction of the ejection of the debris particles from interaction zone 5 is determined by the following factor; the shock wave caused by the laser inside the target 4 after being reflected from the surface 16 of the annular groove 11 can produce ejection of micro droplets oriented mainly in the normal vector 20 to the surface 16. Because of this, to prevent debris particles from getting into the windows 6 and 8, the laser beam 7 and the short-wavelength radiation beam 9 are preferably located on one side of a rotation plane 19 passing through the interaction zone 5, and a normal vector 20 to the annular groove surface 16 in the interaction zone 5 is located on the opposite side of the rotation plane 19.

In these embodiments of the invention the substantial directions of ejection of debris particles differ significantly from directions to input and output windows 6 and 8 and the proximal wall 9 of the annular groove becomes an effective protection shield preventing the exiting of debris particles from the rotating target assembly 3.

The proximal wall 14 of the annular groove 11 can have at least one annular cavity or groove or may be doubled or tripled to improve the blocking of the debris particles from leaving the rotating target assembly 3.

Also to prevent the debris particles from leaving the rotating target assembly 3 the annular groove 11 preferably is provided with a cover 21.

For additional protection of the windows 6 and 8 from debris particles including plasma and vapor of the molten metal, a part of the focused laser beam 7 between the input window 6 and the proximal wall 14 of the annular groove 11 is surrounded by a first casing 22 in which a gas flow from the input window 6 to the proximal wall 14 of the annular groove 11 is supplied. Similarly, a part of the short-wavelength radiation beam 9 between the proximal wall 14 of the annular groove 11 and the output window 8 is surrounded by a second casing 23 in which a gas flow from the output window 8 to the proximal wall 14 of the annular groove 11 is supplied. Gas flows are supplied by means of gas inlets 10.

The output window 8 of the vacuum chamber 1 may be an opening or may have a spectral filter with relatively high transparency for short-wavelength radiation. The short-wavelength radiation can be directed to a collector mirror 24 located outside the vacuum chamber 1 in the optical box 25 which is filled with an inert gas.

The gas flows inside the casings 22 and 23 prevent plasma and vapor of the target material from moving towards the windows 6 and 8 thus protecting them from contamination.

For further protection from the ion streams, the devices for magnetic field generation 26, for example permanent magnets, are arranged on the outer surfaces of the first and second casings 22 and 23. The magnetic fields are oriented preferably across the axis of laser beam 7 and short-wavelength radiation beam 9 to prevent plasma from moving towards windows 6 and 8.

Foil traps, combining high radiation transparency and a large surface area for the deposition of debris particles, may be installed in the first and second casings 22 and 23 to provide additional improvement of debris mitigation.

In the embodiments of the invention the first and second casings 22 and 23 may be integrated together.

To avoid blocking of the focused laser beam 7 and the short-wavelength radiation beam 9 by the rotational drive unit 2, the beams 7, 9 are preferably located on one side of a rotation plane 19 passing through the interaction zone 5, and the rotational drive unit 2 is located on the opposite side of the rotation plane 19, as shown in FIG. 1

Different variants of design of the rotating target assembly 3 may have axis of rotation 12 vertical or inclined to vertical.

Preferably, the target assembly rotational speed (v) is high enough, ranging from 20 Hz to 10 kHz, to provide the following factors:

Most of the droplet fractions of the debris particles exiting the rotating target assembly 3 are not directed towards the input and output windows 6, 8, the surface of the target 4 is close to parallel to the axis of rotation 12, in the arrangement with openings 17, 18, they obstruct the passage of the debris through the proximal wall 14 by closing the line of sight between the interaction zone 5 and both the input and output windows 6, 8 due to rotation of the proximal wall 14 until the next cycle of radiation generation, droplets flying into openings 17, 18 collide with the walls of these openings, which trap the debris particles, centrifugal force is large enough to eject the trapped droplets with dimensions ~100 μm and less back to the annular groove 11.

The debris particles consist of droplets, vapor and ions of the molten metal. Typical velocity of droplets is ~$10^2$ m/s for Sn and ~$10^3$ m/s for Li, ~$10^3$ m/s for vapor, $10^5$ m/s for ions.

Overall, if the high-brightness LPP source of short-wavelength radiation is made according to the present invention its purity is achieved due to the following factors:

the high orbital velocity of the rotating target assembly provides extremely efficient mitigation of the droplet fraction and partial mitigation of the vapor fraction of the debris, gas flows effectively mitigate the vapor fraction and partially the ion fraction of the debris, magnetic fields effectively mitigate the ion fraction of the debris particles.

In the preferred embodiments of the invention the rotating target assembly 3 is provided with a fixed heating system 28 for the target material 15. To keep the target material in a molten state inside the rotating target assembly 3 the heating system 28 should provide no contact induction heating. The fixed heating system 28 may have the option of keeping the temperature of molten metal in the optimal range of temperature.

When metals, such as lithium, with high pressure of saturated vapor are used, the input and output windows 6, 8 may be provided with heaters 29 which perform highly efficient evaporation cleaning of debris from the windows 6, 8 by heating them up to 400-500° C. This temperature ensures that the pressure of Li saturated steam is higher than the pressure of incoming steam. FIG. 1 shows heater 29 only for output window 8, although such evaporating cleaning can be used for input window 6 as well.

In addition input and output windows 6 and 8 may be fitted with a system of gas chemical cleaning. A cleaning gas is employed to remove any deposited debris material that has formed as a thin film on the windows' surfaces. The gas used may be any of the following: hydrogen, hydrogen-containing gas, oxygen-containing gas, fluorine gas, chlorine fluoride gas, bromine fluoride gas or iodine fluoride gas. In accordance of one of the embodiments of the invention the short-wavelength radiation pulses generate low-temperature plasma, along with photo-induced surface activation. Together these combine to yield a highly reactive environment that quickly and efficiently removes deposited debris. By controlling the cleaning gas partial pressure and surface temperature, the plasma environment and cleaning rates can be controlled with a relatively high level of precision. For this the heaters 29 can be used in conjunction with a system of gas chemical cleaning. Currently atomic hydrogen is mainly used to remove different types of contaminants because the majority of basic hydrogen compounds are volatile.

To produce high-temperature laser-produced plasma with high optical output in short-wavelength spectra from ultraviolet to soft x-ray band, the density of power of laser radiation on the target should be from $10^{10}$ to $10^{12}$ W/cm$^2$ and the length of laser pulses—from 100 ns to 0.5 ps.

To generate the laser beam 7 any pulsed or modulated laser or several lasers may be used. The laser may be solid state, fiber, disk, or gas discharge. The average power of laser radiation can be in the range from 10 W up to about 1 kW or more with focusing of the laser beam on a small focus spot on a target, for instance about 100 μm in diameter.

The laser pulse repetition frequency f can be from 1 kHz to 10 MHz. In this range a higher pulse repetition rate at lower output laser energy is preferable for reducing the splash of debris particles.

In the embodiments of the invention the plasma-forming target material is selected from metals providing highly efficient extreme ultraviolet (EUV) light generation, particularly Sn, Li, In, Ga, Pb, Bi or their alloys.

Figure 2:
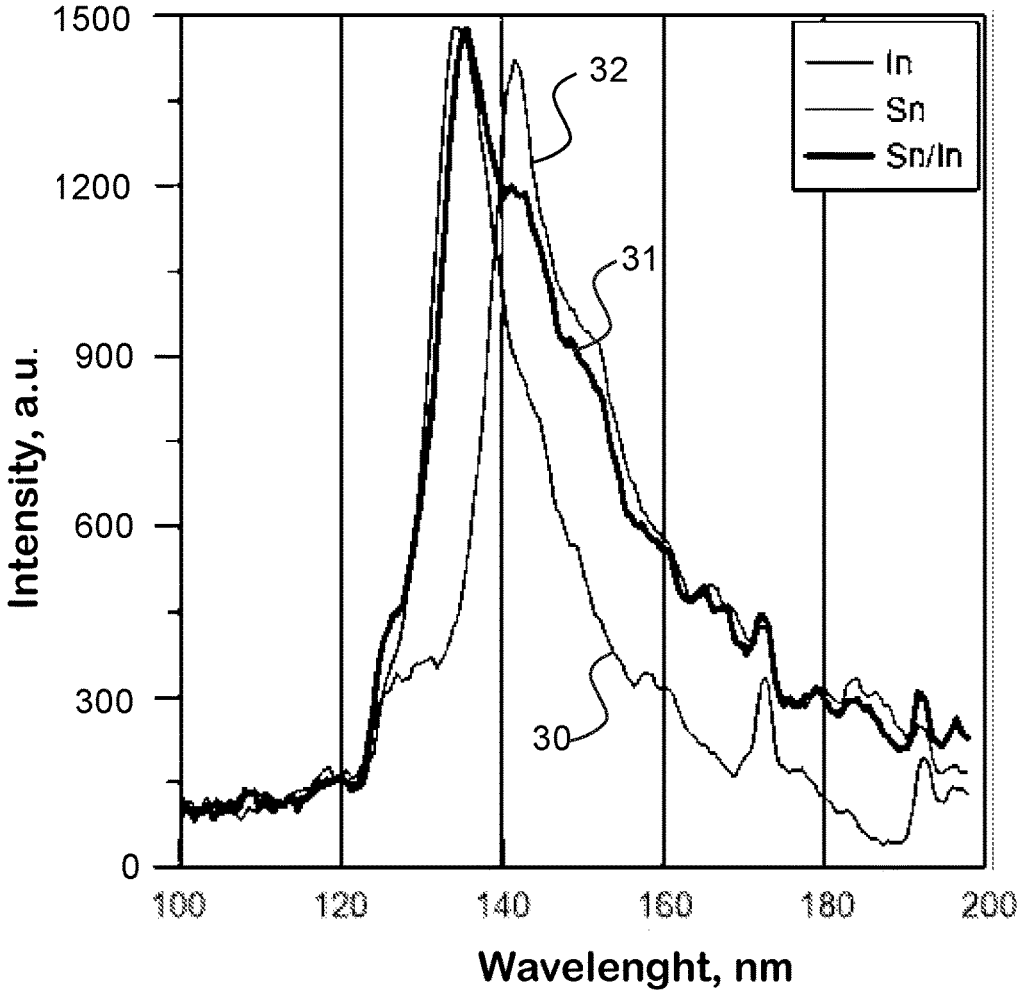
FIG. 2, FIG. 3, FIG. 4 and FIG. 5 show the characteristic emission spectra of laser plasma for various target materials, providing highly efficient EUV light generation, FIGS. 6 and 7 schematically show the mechanism of mitigating the droplet fractions of the debris in accordance with the present invention, FIG. 8 schematically shows the mechanism of obstructing the passage of the debris through the openings in the rotating target assembly. In the drawings, the matching elements of the device have the same reference numbers.

FIG. 2 shows spectra of laser-produced plasma 30, 31 and 32 obtained under the same conditions, where the target material is pure Sn, eutectic alloy Sn/In=52/48 (ratio defines alloy composition) and pure In, respectively. It can be observed, that using these target materials, a similarly high spectral brightness in the EUV region is reached. Using Sn or Sn alloy is preferable for achieving high brightness at 13.5 nm while having high conversion efficiency ($CE_{13.5}$) of laser energy into in-band EUV energy within 13.5 nm+/−0.135 nm. Utilizing a eutectic alloy Sn/In may be preferable, because the alloy's melting temperature is 125° C., significantly lower than the melting temperature of pure Sn which is 232° C.

Figure 3:
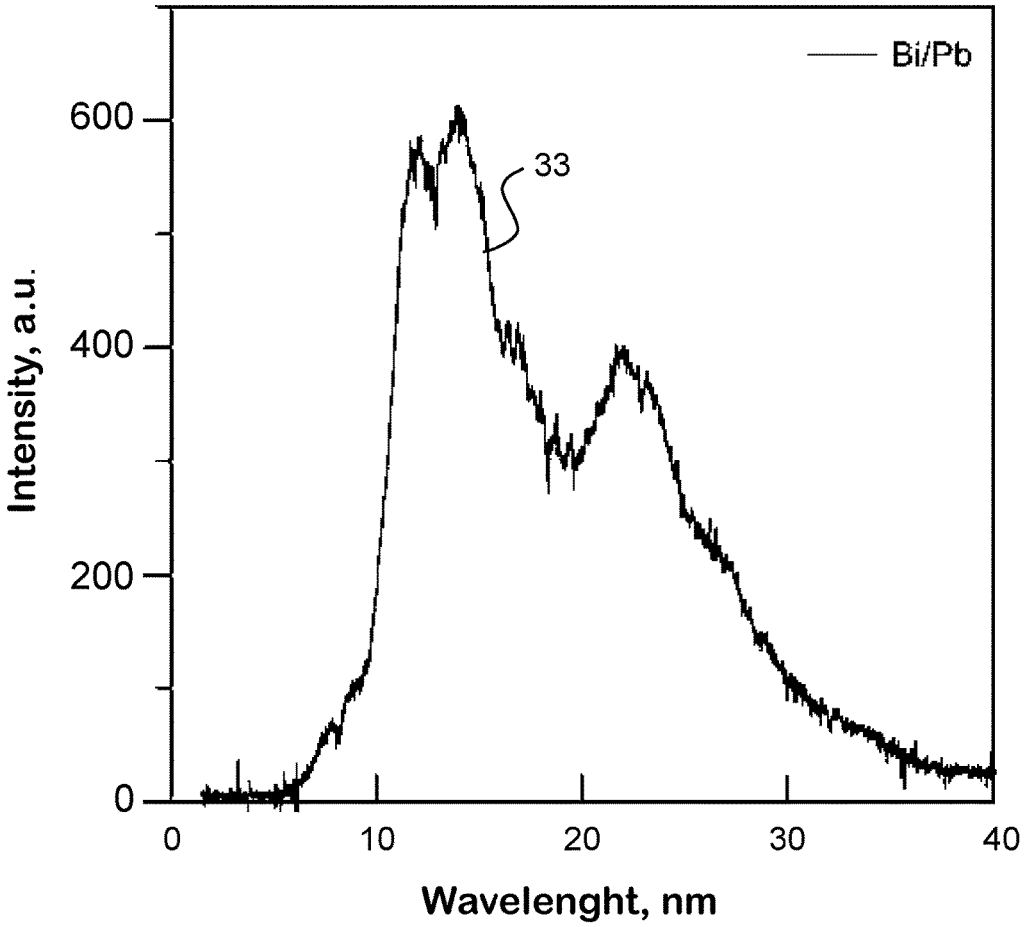

A low-melting temperature target material can also be chosen to contain Bi, Pb and their alloys, in particular, a eutectic alloy Bi/Pb=56.5/43.5, having a melting temperature of 125° C. FIG. 3 depicts a spectrum 33 of a laser-produced plasma using Bi/Pb eutectic alloy as a target. Spectrum is selected to have maximum intensity in the EUV region.

Figure 4:
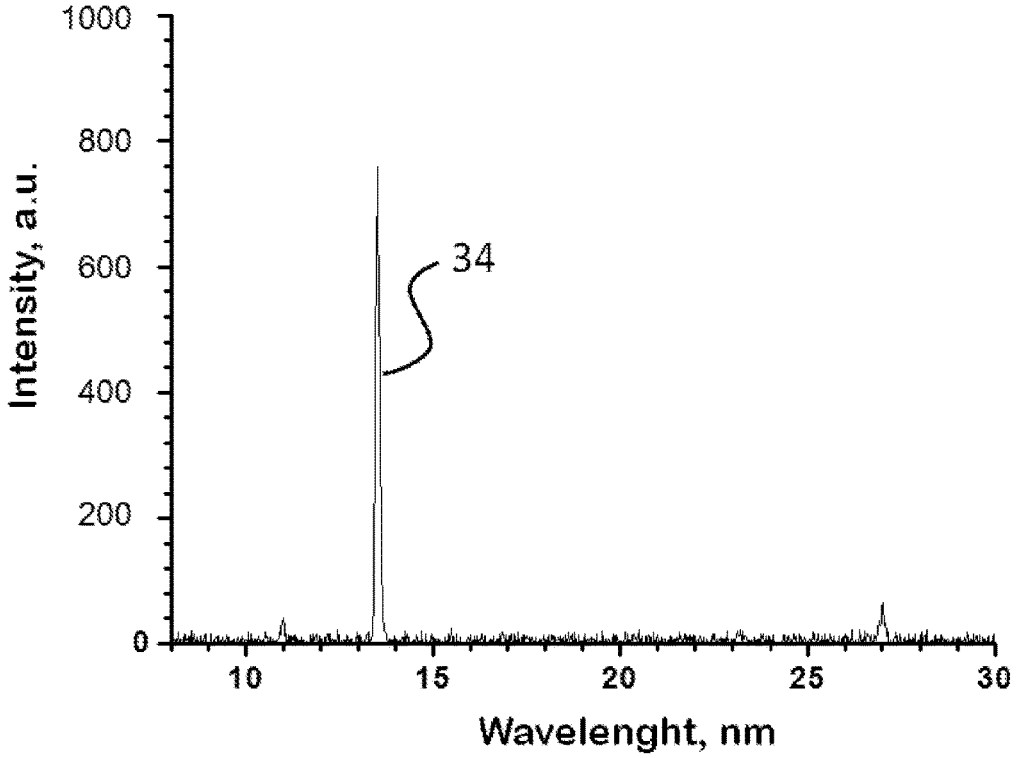

FIG. 4 shows a spectrum 34 of laser-produced plasma, using Li as a target material. Using Li as a target material may be preferable due to I. high conversion efficiency $CE_{13.5}$ up to 2.5%, II. high saturated vapor pressure of Li, providing efficient evaporative cleaning of optical elements at 400-500° C., III. high spectral purity of a light source, which decreases radiative load on EUV optics, IV. low atomic weight of Li and low energy of ions produced by Li plasmas, both decrease risk of optical elements degradation due to ion bombardment, in particular, for a spectral purity filter used as output window.

Figure 5:
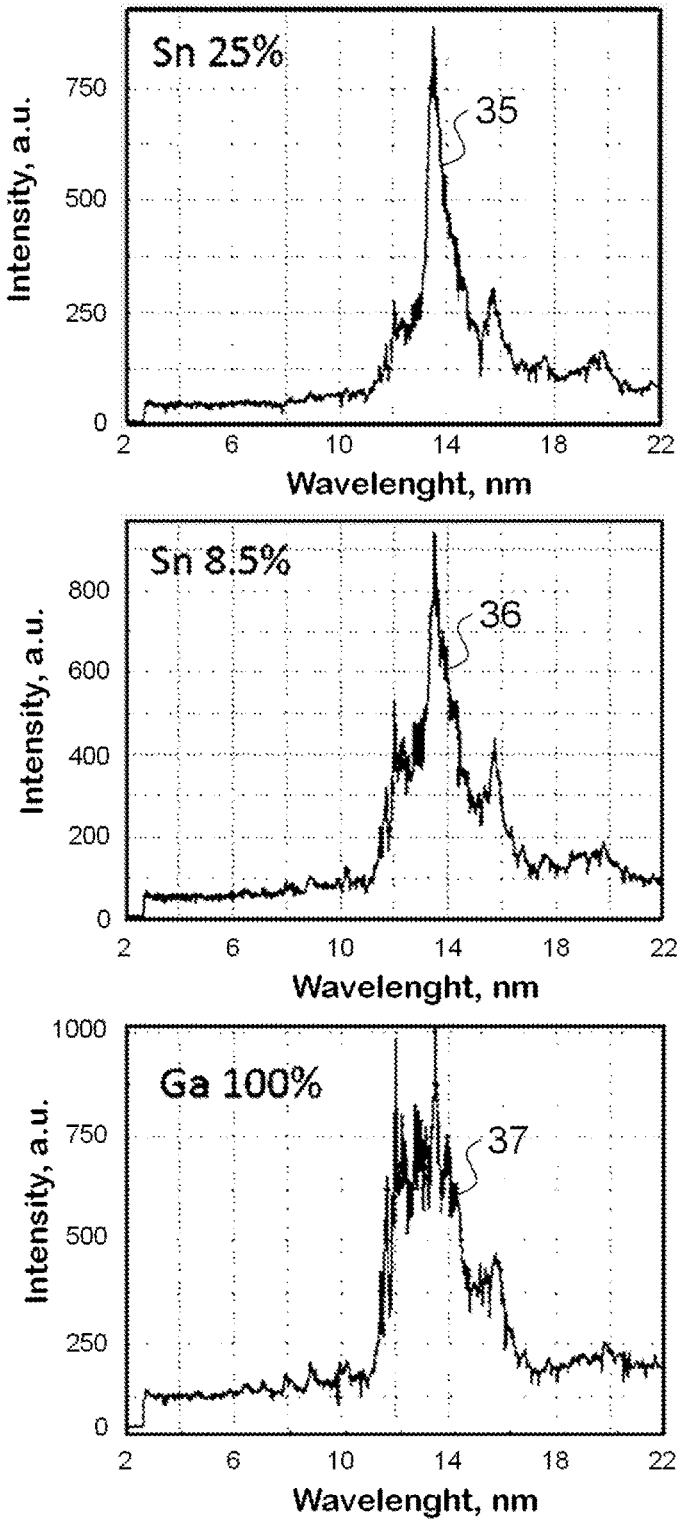

Lower melting temperatures, close to room temperature, can be achieved by using Ga and its alloys as a target material. FIG. 5 shows spectra 35, 36, 37 of laser-produced plasma, where a target material was chosen to be an alloy Sn/Ga=8.5/91.5, Sn/Ga=25/75 and Ga respectively. These target materials allow the achievement of high intensity EUV radiation at low melting temperatures, 20-30° C. Low target melting temperature in turn simplifies the engineering of an apparatus for generating radiation from laser-produced plasmas.

Spectra in FIG. 2, FIG. 3, FIG. 4 and FIG. 5 were obtained with a solid state Nd-YAG laser, operating at wavelength of 1064 nm, laser pulse duration of 17 ns and laser power density on the target of $1.1.10^{11}$ W/cm$^2$.

As an example, a high-brightness LPP EUV light source for EUV mask inspection in accordance with the present invention may be designed (but not limited to) as follows:

I. type of laser: solid state or fiber
II. laser wavelength $\lambda$=1-2 um
III. pulse repetition frequency 10-30 kHz
IV. laser pulse energy 1-50 mJ/pulse
V. orbital target velocity up to 200 m/s
VI. conversion efficiency $CE_{13.5}$—up to 3%
VII. EUV radiation collection solid angle, $\Omega$=0.04 sr
VIII. brightness of EUV source $B_{13.5}$—up to 2 kW/mm$^2$sr.

A method for generating short-wavelength radiation, realized in particular in a high-brightness LPP source schematically shown in FIG. 1, comprises: forming a target 4 by centrifugal force as a layer of molten metal on a surface 16 of an annular groove 11, implemented inside a rotating target assembly 3; sending a pulsed laser beam 7 through an input window 6 of a vacuum chamber 1 into an interaction zone 5 while providing a line of sight between the interaction zone 5 and both the input and output windows 6, 8 particularly during laser pulses. The method further comprises irradiating a target 4 on a surface of a rotating target assembly 3 by a laser beam 7 and passing a generated short-wavelength radiation beam 9 through an output window 8 of a vacuum chamber 1.

The vacuum chamber 1 is evacuated with an oil-free pump system to below $10^{-5}$-$10^{-8}$ bar, thus removing gas components such as nitrogen and carbon which are capable of interacting with the target material.

The rotating target assembly 3 is driven by means of an electromotor with a shaft or by any other rotational drive unit The target material is preferably kept molten using an inductive heating system 28, configured to permit temperature stabilization of target material in order to keep it within the optimal temperature range.

Figure 6:
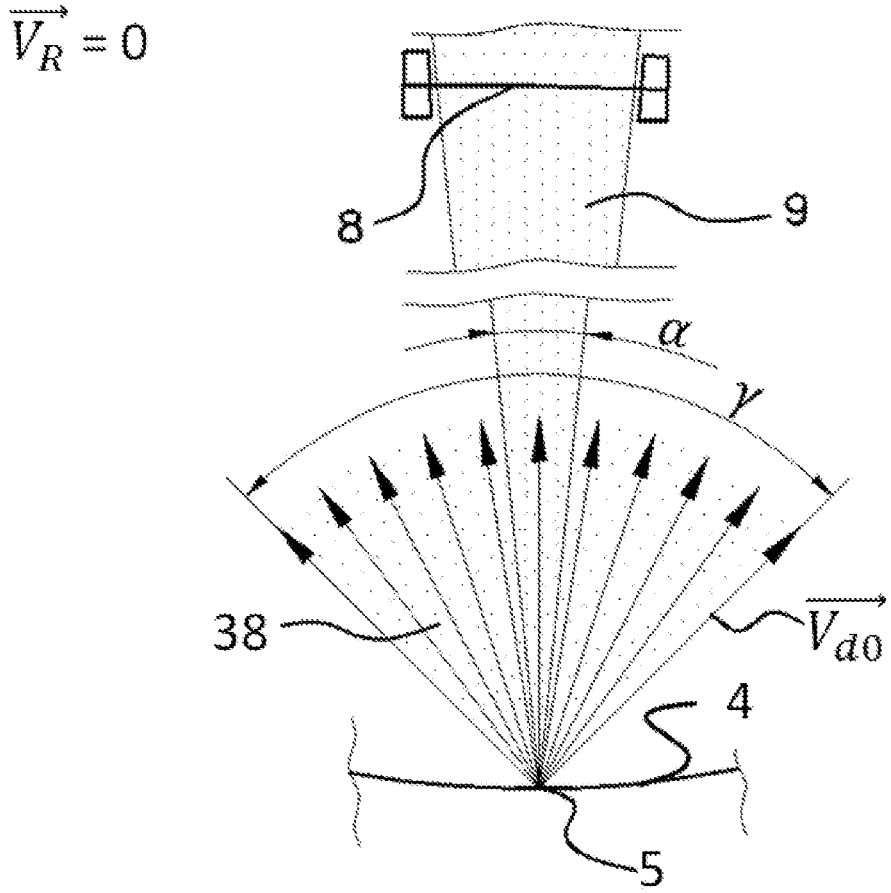
Figure 7:
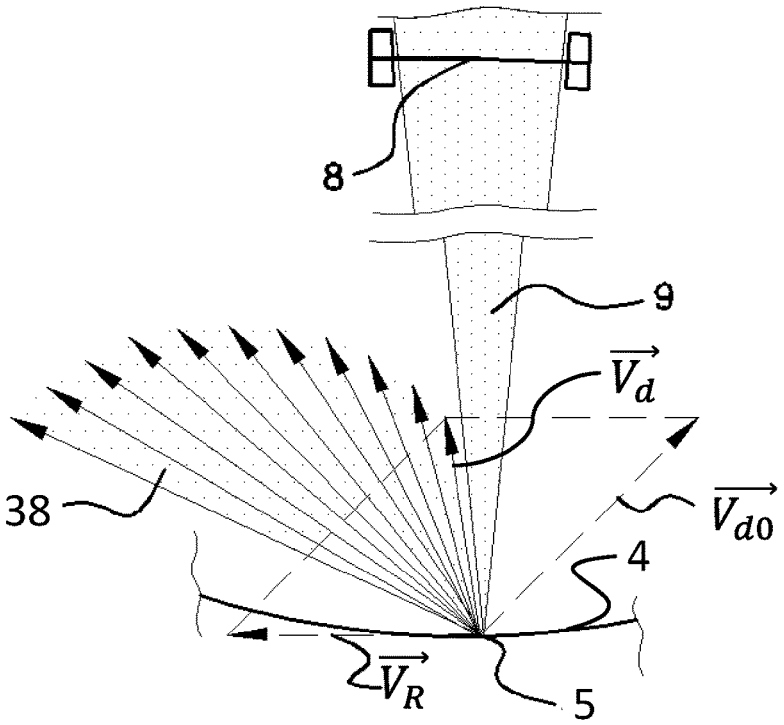

The new method for mitigating debris particles realized in the description above of a high-brightness LPP source for short-wavelength radiation, is schematically illustrated by FIG. 6 and FIG. 7, which show the velocity diagrams in flow 38 of the droplet fractions of the debris.

FIG. 6 depicts the hypothetical case when: the orbital velocity $V_R$ of the target 4 is zero: $V_R$=0; the characteristic escape velocity of the droplet fractions is $V_{d0}$, the short-wavelength radiation beam 9 is characterized by the opening angle $\alpha$ while flow 38 of the droplet fractions is characterized by the total escape angle $\gamma$. The angle $\alpha$ also corresponds to the collection angle of the output window 8 of the LPP source. In the case when $V_R$=0, flow 38 of the droplet fractions is substantially directed towards the output window 8, as shown in FIG. 6.

However, if the velocity vector $\vec{V}_{d0}$ of each droplet is added to a sufficiently large orbital velocity component $\vec{V}_R$, the situation will change so that flow 38 of the droplet fractions will not be directed towards the output window 8 (and/or to input window 6), as shown in FIG. 7. So in accordance with the above simplified consideration, a method for mitigating debris in a LPP source constructed according to the present invention, consists of using an orbital velocity $V_R$ for the rotating target assembly (3) high enough for the droplet fractions of the debris particles exiting the rotating target assembly not to be directed towards the input and output windows (6) and (8).

The condition that the flow of droplet fractions is not directed to the input or output windows 6, 8 is described by the following expression:

$$|\vec{V}_R| \geq |\vec{V}_{d0}|[\sin(\gamma/2)+\cos(\gamma/2)\tan(\alpha/2)] \quad (1).$$

For example, when Sn is used as a plasma-forming target material, the characteristic escape velocity of the droplet fractions is $V_{d0}\approx$100 m/s. Then for the collection angle $\alpha\approx$12°, total escape angle $\gamma$=90° and the radius of the target orbital circle R=10 cm, the orbital velocity $V_R$ of the target 4 should be 80 m/s or higher. This example corresponds to an embodiment of the invention for which the proximate wall 14 of the annular groove 11 has a slit along its entire perimeter to provide a line of sight between the interaction zone and both the input and output windows.

In another embodiment of the invention, illustrated by FIG. 1, improved mitigation of all types of debris particles is achieved due to the restriction of the debris flow by the apertures of the two openings 17, 18 in the proximal wall 14, which provide a line of sight between the interaction zone 5 and both the input and output windows (6) and (8) during laser pulses. In this embodiment improved mitigation of debris particles is also achieved due to the obstruction of the passage of the debris through the proximal wall 14, by closing the line of sight between the interaction zone 5 and both the input and output windows 6, 8 due to rotation of the proximal wall 14 until the next cycle of short-wavelength radiation generation.

Figure 8:
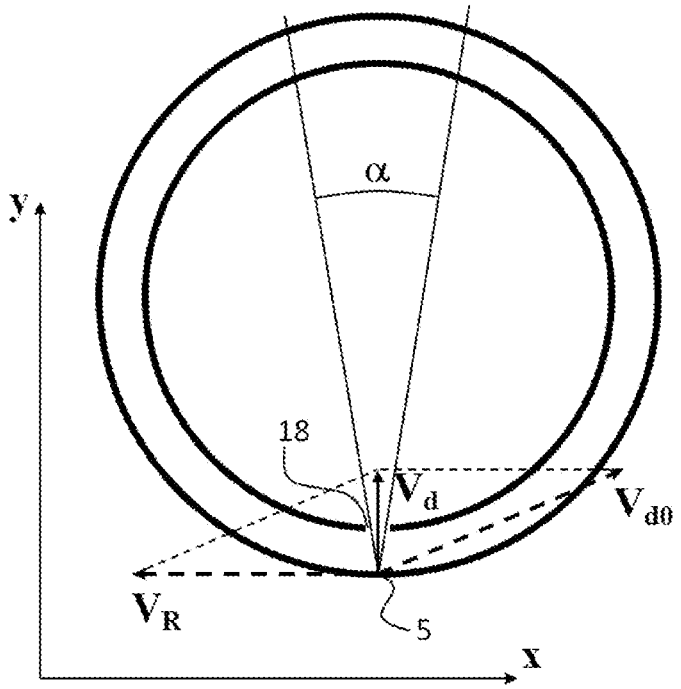

FIG. 8 schematically shows the mechanism of obstructing the passage of the debris through the openings 18 in the rotating target assembly. As seen from FIG. 8, all droplets created at interaction zone 5 with velocity $V_x<V_R$ do not fall into the radiation collection angle $\alpha$. Only the part of the droplets, whose total velocity $V_{d0}$ (in a rotating coordinate system) exceeds $V_R$, and the component Vx, is close to $V_R$—are directed into the collection angle $\alpha$.

If such a droplet has a velocity $V_y$ in the direction of collection angle $\alpha$, then it takes time $\Delta t=\Delta R/V_y$ to traverse the distance $\Delta R$ between the distal and proximal walls. The opening 18 for the short-wavelength beam output will shift to $\Delta x=V_R\cdot\Delta t$. The size d of this opening 18 is given by the radiation collection angle: $d=2\cdot\Delta R\cdot\sin(\alpha/2)$. If the displacement is greater than the diameter of this opening, then the droplets do not pass into it, i.e. the droplets with $V_y<V_R/(2\cdot\sin(\alpha/2))$ are cut off. So for $\sin(\alpha/2)$=0.1 and $V_R$=200 m/s all droplets with the velocity $V_{d0}$ less than $(V_y^2+V_R^2)^{1/2}$=1020 m/s are obstructed or cut off.

So the proposed method of debris mitigation provides the obstruction of the passage of debris through the proximal wall, by closing the line of sight between the interaction zone 5 and both the input and output windows 6, 8 due to rotation of the proximal wall until the next cycle of operation.

To improve debris mitigation, the openings 17, 18 may be made in the form of elongated channels whose surfaces act as rotating debris-traps and eject the trapped debris particles by centrifugal force back into the groove 11, FIG. 1. Along with this the twin openings 17 and 18 may be joined to simplify the design and operation of the LPP source.

To prevent the ionized and neutral debris particles from moving towards windows 6 and 8, the devices for magnetic field generation 26, foil traps 27 and buffer gas flows to the foil trap or the gas curtains, provided by gas inlets 10 are additionally used in preferred embodiments of the invention, FIG. 1.

In general, an apparatus and methods, arranged in accordance with the present inventions, provide a high-brightness low-debris short-wavelength radiation source characterized by long lifetime and low cost of operation.

INDUSTRIAL APPLICATIONS

The proposed apparatus and method are intended for a variety of applications, including EUV metrology and inspection of nano- and microstructures. One of the main results of the invention is to enable the development of a radiation source that meets the requirements of light sources for actinic mask inspection in EUV lithography.

LIST OF SYMBOLS 1. vacuum chamber
2. rotational drive unit
3. rotating target assembly
4. target
5. interaction zone
6. input window
7. laser beam
8. output window
9. short-wavelength radiation beam
10. gas inlets
11. annular groove
12. axis of rotation
13. distal wall
14. proximal wall
15. molten metal
16. inner surface of the distal wall
17. n first openings
18. n second openings
19. plane of rotation passing through the interaction zone
20. normal to the distal wall
21. cover
22. first casing
23. second casing
24. collector mirror
25. optical box
26. devices for a magnetic field generation
27. foil trap
28. fixed heating system
29. heater
30. spectrum of Sn-plasma
31. spectrum of Sn/In 52/48-plasma
32. spectrum of In plasma
33. spectrum of Bi/Pb56,5/43,5-plasma
34. .spectrum of Li-plasma
35. spectrum of Sn/Ga8,5/91,5-plasma
36. spectrum of Sn/Ga25/75-plasma
37. spectrum of Ga-plasma
38. flow of the droplet fractions

What is claimed is:

1. An apparatus for generating a short-wavelength radiation beam from a laser-produced plasma (LPP), comprising:

a vacuum chamber (1) containing a rotational drive unit (2) coupled to a rotating target assembly (3) which supplies a target (4) to an interaction zone (5), an input window (6) for a pulsed laser beam (7) focused into the interaction zone, an output window (8) for an exit of the short-wavelength radiation beam (9), and gas inlets (10), characterized in that the rotating target assembly (3) has an annular groove (11) with a distal wall (13) and a proximal wall (14) relative to an axis of rotation (12);

the plasma-forming target material (15) is a molten metal located inside the annular groove (11), and the target (4) is a layer of said molten metal formed by a centrifugal force on a surface (16) of the distal wall (13) of the annular groove (11), and the proximal wall (14) of the annular groove (11) is designed to provide a line of sight between the interaction zone (5) and both the input and output windows (6), (8) particularly during laser pulses.

2. The apparatus according to claim 1, wherein the proximal wall (14) of the annular groove (11) has n pairs of openings (17) and (18) arranged on a groove circumference, in each of the pairs, a first opening (17) is provided for a focused laser beam (7) input into the interaction zone (5), and a second opening (18) is provided for a short-wavelength radiation beam (9) output from the interaction zone during the laser pulses that follow at a frequency f equal to a target assembly rotational speed (v) multiplied by the number of the opening pairs n:

$$f=v\cdot n,$$

further comprising a synchronization system which adjusts the annular groove (11) rotation angle with laser pulses timed to provide a line of sight between the interaction zone (5) and both the input and output windows (6) and (8).

3. The apparatus according to claim 2, wherein each twin openings (17) and (18) are joined.

4. The apparatus according to claim 1, wherein the proximal wall (14) of the annular groove (11) has a slit along its entire perimeter providing a line of sight between the interaction zone (5) and both the input and output windows (6) and (8).

5. The apparatus according to claim 1, wherein the rotating target assembly (3) is provided with a fixed heating system (28) for the target material (15).

6. The apparatus according to claim 1, wherein the laser beam (7) and the short-wavelength radiation beam (9) are located on one side of a rotation plane (19) passing through the interaction zone (5), and a normal vector (20) to the annular groove surface (16) in the interaction zone (5) is located on the opposite side of the rotation plane (19).

7. The apparatus according to claim 1, wherein the laser beam (7) and the short-wavelength radiation beam (9) are located on one side of a rotation plane (19) passing through the interaction zone (5), and the rotational drive unit (2) is located on the opposite side of the rotation plane (19).

8. The apparatus according to claim 1, wherein the annular groove (11) is provided with a cover (21).

9. The apparatus according to claim 1, wherein a part of the focused laser beam (7) between the input window (6) and the proximal wall (14) of the annular groove (11) is surrounded by a first casing (22) in which a gas flow from the input window (6) to the proximal wall (14) of the annular groove (11) is supplied, and a part of the short-wavelength radiation beam (9) between the proximal wall (14) of the annular groove (11) and the output window (8) is surrounded by a second casing (23) in which a gas flow from the output window (8) to the proximal wall (14) of the annular groove (11) is supplied.

10. The apparatus according to claim 9, wherein devices for magnetic field generation (26) are arranged on outer surfaces of the first and second casings (22) and (23).

11. The apparatus according to claim 9, wherein the first and second casings (22) and (23) are integrated together.

12. The apparatus according to claim 1, wherein the input and output windows (6), (8) are provided with heaters (29) performing highly efficient cleaning by evaporation of debris from the windows (6), (8).

13. The apparatus according to claim 1, wherein the input and output windows (6), (8) are provided with a system of gas chemical cleaning.

14. The apparatus according to claim 1, wherein the plasma-forming target material is selected from metals providing highly efficient extreme ultraviolet (EUV) light generation, particularly including Sn, Li, In, Ga, Pb, Bi or their alloys.

15. A method for generating radiation from a laser-produced plasma, comprising:

forming a target (4) by centrifugal force as a layer of molten metal on a surface (16) of an annular groove (11), implemented inside a rotating target assembly (3);

sending a pulsed laser beam (7) through an input window (6)) of a vacuum chamber (1) into an interaction zone (5) while providing a line of sight between the interaction zone (5) and both the input and output windows (6), (8) particularly during laser pulses, irradiating a target (4) on a surface of a rotating target assembly (3) by a laser beam (7), and passing a generated short-wavelength radiation beam (9) through an output window (8) of a vacuum chamber (1).

16. A method for mitigating debris in a laser-produced plasma (LPP) source, characterized by irradiating a target (4) on a surface of a rotating target assembly (3) with a pulsed laser beam (7), while the laser beam (7) enters through the input window (6) and a generated short-wavelength radiation beam (9) exits through the output window (8) of a vacuum chamber (1), said method comprising:

the target (4) formation by centrifugal force as a layer of molten metal on a surface (16) of an annular groove (11), implemented inside the rotating target assembly (3), and using an orbital velocity $V_R$ of the rotating target assembly (3) high enough for the droplet fractions of the debris particles exiting the rotating target assembly not to be directed towards the input and output windows (6) and (8).

17. The method according to claim 16, wherein the groove has a distal wall (13) and a proximal wall (14) relative to an axis of rotation (12); the proximal wall (14) has n pairs of openings (17), (18) arranged for the focused laser beam (7) input into an interaction zone (5) and for a short-wavelength radiation beam (9) output from the interaction zone (5) during the laser pulses that follow at a frequency f equal to an orbital velocity $V_R$ of rotating target assembly multiplied by the number n of the opening pairs and divided by the length of the orbital circle $2\pi R$: $f=V_R \cdot n/(2\pi R)$, said method comprising:

forming the target (4) on a surface (16) of the distal wall (13) of the annular groove (11), providing a line of sight between the interaction zone (5) and both the input and output windows (6) and (8) by means of two openings (17), (18), irradiating a target (4) on the surface of a rotating target assembly (3) by a laser beam (7) and passing a generated short-wavelength radiation beam (9) through the output window (8) of a vacuum chamber (1), restricting a debris flow, generated from the interaction zone (5), by apertures of two openings (17), (18), obstructing the passage of the debris through the proximal wall (14), by closing the line of sight between the interaction zone (5) and both the input and output windows (6), (8) due to rotation of the proximal wall (14) until the next cycle of operation.

18. The method according to claim 17, wherein openings (17), (18) are elongated channels, which act as rotating debris-trapping surfaces, and said method comprising: trapping the debris particles on the surfaces of the said elongated channels (17), (18) and ejecting the trapped debris particles by centrifugal force back into the groove (11).

19. The method according to claim 16, wherein debris mitigation techniques such as magnetic mitigation, gas curtain and foil traps are additionally used.

* * * * *